US006250955B1

(12) United States Patent
Archuleta

(10) Patent No.: US 6,250,955 B1
(45) Date of Patent: Jun. 26, 2001

(54) PIGTAILED SCOTCHCAST ASSEMBLY

(76) Inventor: David Archuleta, 178 Miller St., Ludlow, MA (US) 01056

( * ) Notice: Subject to any disclaimer, the term of this patent is extended or adjusted under 35 U.S.C. 154(b) by 0 days.

(21) Appl. No.: 09/466,707

(22) Filed: Dec. 17, 1999

(51) Int. Cl.[7] ..... H01R 11/00
(52) U.S. Cl. ..... 439/502
(58) Field of Search ..... 439/502, 527, 439/559, 544; 277/602

(56) References Cited

U.S. PATENT DOCUMENTS

| | | | | |
|---|---|---|---|---|
| 2,247,336 | | 3/1940 | John | 173/328 |
| 2,312,002 | | 12/1940 | Schmitt | 173/328 |
| 2,912,667 | | 11/1959 | Sloat . | |
| 2,962,688 | | 11/1960 | Werner | 339/89 |
| 3,229,240 | | 1/1966 | Harrison et al. . | |
| 3,753,766 | | 8/1973 | Brown et al. | 117/97 |
| 3,821,558 | | 3/1964 | Weber | 200/129 |
| 3,885,849 | | 5/1975 | Bailey et al. . | |
| 4,309,128 | | 1/1982 | Williams | 405/154 |
| 4,810,209 | | 3/1989 | Punako et al. | 439/589 |
| 4,911,579 | | 3/1990 | Lutz et al. | 405/184 |
| 5,318,459 | * | 6/1994 | Shields | 439/527 |
| 5,372,162 | | 12/1994 | Frey | 138/98 |
| 5,709,503 | | 1/1998 | Manlow | 405/154 |
| 6,007,372 | * | 6/1994 | Wood | 439/502 |

FOREIGN PATENT DOCUMENTS

| | | | | |
|---|---|---|---|---|
| 224657 | * | 8/1987 | (EP) | 439/610 |

* cited by examiner

*Primary Examiner*—Brian Sircus
*Assistant Examiner*—J F. Duverne
(74) *Attorney, Agent, or Firm*—McCormick, Paulding & Huber LLP

(57) ABSTRACT

A pigtailed scotchcast assembly includes a first portion adapted to have the pigtail extending from one end and a male end oriented adjacent to another end thereof. A second portion comprising a scotchcast adapted to have the electrical cable extending from one end and a female end oriented adjacent another end thereof, is also included so that the first portion and the second portion are capable of mating with one another. The pigtailed scotchcast assembly provides for the efficient exchange or replacement of pigtails from a pigtailed scotchcast assembly. The pigtailed scotchcast assembly is provided for enabling a quick and efficient exchange and replacement or replacement of pigtails from the pigtailed scotchcast assembly without wire splicing or special tools.

13 Claims, 3 Drawing Sheets

PIGTAILED SCOTCHCAST ASSEMBLY

FIELD OF THE INVENTION

The present invention relates generally to a pigtailed scotchcast assembly, and deals more particularly with an apparatus that provides for the efficient exchange or replacement of pigtails from a pigtailed scotchcast assembly.

BACKGROUND OF THE INVENTION

A pigtailed scotchcast assembly is utilized in those fields requiring either pre- or post-inspection of extended cavities, ducts or piping, such as but not limited to the sewer pipe relining industry. In such fields, it is typically necessary to inspect the condition of an extended cavity through the use of a plurality of electrical components. Cameras, lights, cutters and other components are utilized for this purpose and must each be supplied with electrical power to operate. As these cavities are either too confining, unsafe or otherwise unaccommodating for a human presence, the movement of electrical components along the length of any given cavity must be performed by mechanical means. A pigtailed scotchcast assembly is therefore enlisted to provide electrical power to the various components utilized, while also assisting in pulling such components and their associated electrical wiring through the cavity itself.

As is currently known and depicted in prior art FIG. 1, a typical pigtailed scotchcast assembly 10 is comprised of a scotchcast 12 having an electrical cable 14 entering one end thereof and a plurality of pigtails 16 exiting the opposing end of the scotchcast 12. The scotchcast 12 includes a pair of wings 18 each having an anchor hole 20 formed therein for dragging or pulling the pigtailed scotchcast assembly 10 along a cavity or piping. The electrical cable 14 is separated into differing bundles of conductors inside the body of the scotchcast 12 and subsequently emerges from the scotchcast 12 as pigtails 16. The interior of the scotchcast 12 is filled with a resin and catalyst compound which, when sufficiently dried and cured over time, provides a water-tight sealant to the scotchcast 12 and the wire bundles therein.

As will be readily appreciated, when the pigtailed scotchcast assembly 10 is dragged or pulled through many cavities or pipes, the pigtails 16, including the protective sheathing covering the pigtails 16, tend to wear and become tattered, leading to operational failure of the supported electrical components. In these instances, inspection of the cavity or piping must be halted while the entire scotchcast assembly 10 is severed from the electrical cable 14 and another assembly attached in its place. This method is time-consuming, costly, requires expertise in electronics and must frequently accommodate the recommended 12-hour time period that a typical insulating and waterproofing resin and catalyst compound requires to cure.

With the foregoing problems and concerns in mind, it would therefore be advantageous to develop a pigtailed scotchcast assembly, which overcomes the above-described drawbacks, thereby accommodating an exchange or replacement of pigtails quickly and efficiently without the need to replace the scotchcast or splice the electrical cable.

SUMMARY OF THE INVENTION

It is therefore an object of the present invention provide a pigtailed scotchcast assembly which may allow for efficient exchange or replacement of differing pigtails.

It is another object of the present invention to provide a pigtailed scotchcast assembly, which allows for the exchange or replacement of differing pigtails without the need for special instruments or in-depth electrical knowledge.

It is another object of the present invention to provide a pigtailed scotchcast assembly, which allows for the exchange or replacement of differing pigtails while utilizing a common scotchcast and eliminating the need for splicing the electrical cable.

It is another object of the present invention to provide a pigtailed scotchcast assembly having a two-piece design and which includes a device to protect the transitional boundary between the two pieces.

It is another object of the present invention to provide a pigtailed scotchcast assembly with increased pulling capability.

According to one embodiment of the present invention, a pigtailed scotchcast assembly includes an integrated inspection apparatus for selectively housing therein an electrical cable having a plurality of conductors and terminating in a pigtail.

Such an inspection apparatus includes a first portion adapted to have the pigtail extending from one end and including a male end oriented adjacent another end thereof. A second portion, comprising a scotchcast adapted to have the electrical cable extending from one end and including a female end oriented adjacent another end thereof, is also included so that the first portion and the second portion are capable of mating with one another.

The inspection apparatus also comprises an end plug and a seal circumscribing the electrical cable wherein the seal is adapted to be located between the scotchcast and the end plug. The end plug is selectively mated with the scotchcast thereby securing the seal within said scotchcast in a water-tight manner.

The inspection apparatus may also include a protective sheath adapted to surround an interface between the first portion and the second portion, wherein an outer surface of the protective sheath is substantially coextensive with an outer surface of the scotchcast when the first portion and the second portion are mated to one another.

DETAILED DESCRIPTION OF THE PREFERRED EMBODIMENTS

Figure 1:
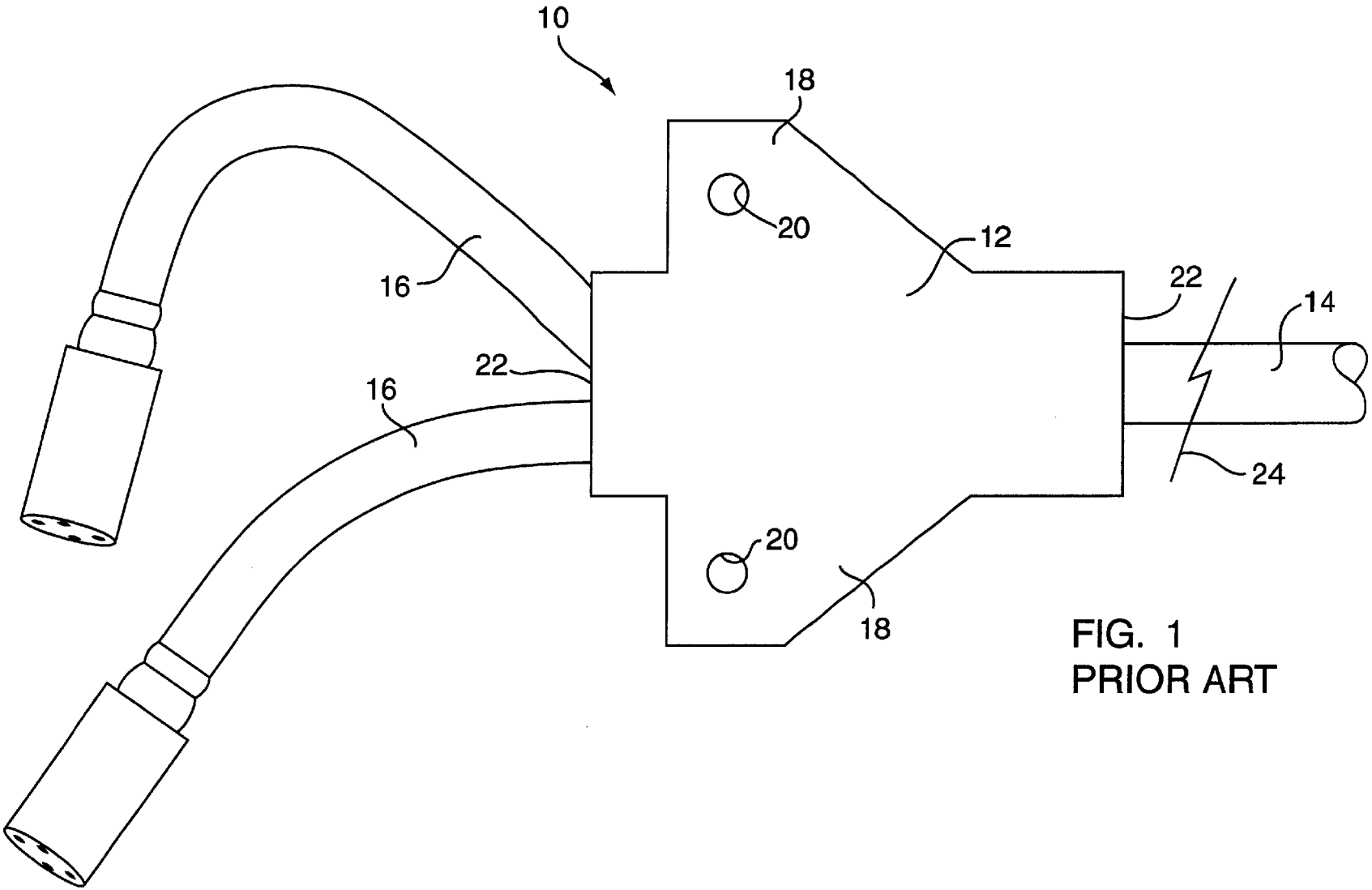
FIG. 1 PRIOR ART
FIG. 1 illustrates a one-piece pigtailed scotchcast assembly, as is commonly known in the art.

As previously discussed, FIG. 1 illustrates a known one-piece pigtailed scotchcast assembly 10 wherein the inner cavity of the scotchcast 12 is sealed in a water-tight manner by the introduction of a known resin and catalyst compound 22. Owing to this configuration, the electrical cable 14 must be severed from the scotchcast assembly 10, as indicated by a cut line 24, during times of operational failure of the pigtails 16. An expensive, time-consuming and precise series of operations must then be undertaken in order to replace the one-piece pigtailed scotchcast assembly 10 whereby a new pigtailed scotchcast assembly is to be prepared and spliced together with the existing electrical cable 14 prior to the resumption of inspection duties by the scotchcast assembly.

Figure 2:
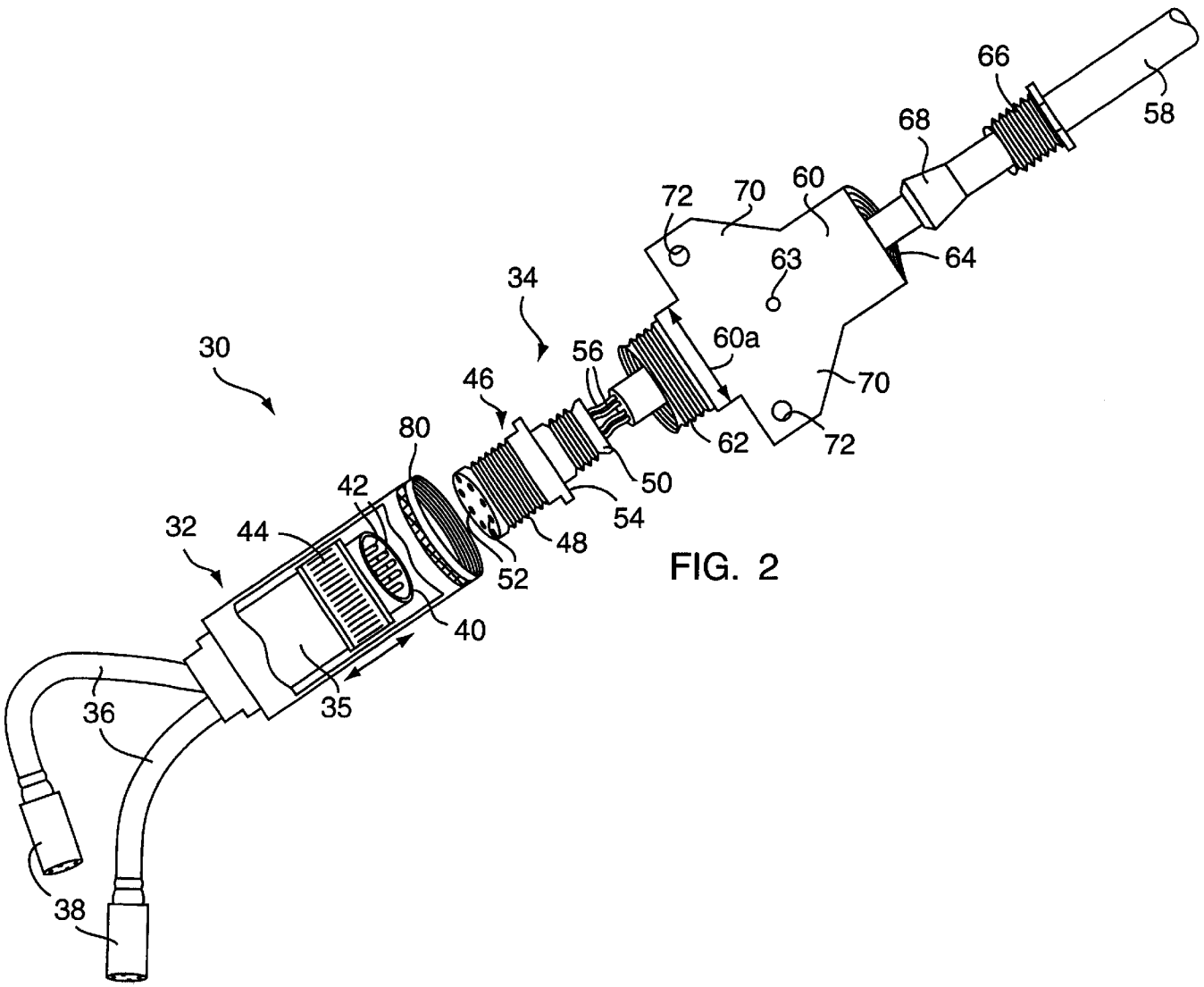
FIG. 2 is a composite view of a two-piece scotchcast assembly according to one embodiment of the present invention.

As depicted in FIG. 2, the present invention is directed towards a two-piece pigtailed scotchcast assembly 30 which is comprised of a first portion 32 capable of integrally and selectively mating with a second portion 34. The first portion 32 includes a central housing 35 from which a plurality of pigtails 36 are adapted to extend. The pigtails 36 each contain a varying number of electrical conductors and terminate in a connection end 38 for connection with electrical components utilized in fields such as but not limited to the inspection of cavities, pipes or other inaccessible locations. While only two pigtails 36 are shown in FIG. 2, the present invention is not limited in this regard as any number of pigtails may be alternatively accommodated given the specific use of the pigtailed scotchcast assembly 30 without departing from the broader aspects of the present invention.

The conductors within each pigtail 36 extend the length of the central housing 35 and are secured in a water-tight manner by the injection of a non-conductive resin and catalyst compound into the interior cavity of the central housing 35. The non-conductive resin and catalyst compound may be any of a group of known compounds which, when given sufficient time to cure, provides a water-proof and resilient filler for the central housing 35. Moreover, the conductors of each pigtail 36 may be spliced together, or not, within the central housing 35 before terminating in a male attachment end 40. The male attachment end 40 comprises a plurality of preferably evenly spaced connection pins 42 representing the conductors within each pigtail 36. A knurled operation ring 44 circumscribes the central housing 35 and is fixed thereto, in a manner known to those in the art, so as to freely rotate about the circumference of the central housing 35. The operation ring 44 has threads inscribed about its inner circumference and is selectively operated in order to join the first portion 32 of the pigtailed scotchcast assembly 30 to the second portion 34, as will be described in more detail later.

Still in reference to FIG. 2, the second portion 34 includes a threaded connection piece 46 having a female attachment end 48 and a connecting tip 50. The female attachment end 48 has exterior threads formed on the outer circumference thereof and further includes a plurality of pin receptacles 52. The pin receptacles 52 are arranged in number and orientation so as to match and integrally mate with the connection pins 42 of the male attachment end 40. The male and female attachment ends 40 and 48 respectively, are brought into water-tight contact with one another as the threads of the female attachment end 48 are selectively engaged with the inner threads of the operation ring 44.

The connecting tip 50 also has exterior threads formed on the outer circumference thereof, as well as being equipped with a plurality of outwardly extending posts 56 which are utilized to anchor the conductors of an electrical cable 58 through a known soldering process or the like. The female attachment end 48 and the connecting tip 50 are adapted to include interior electrical conduits (unillustrated) for providing a plurality of continuous electrically conductive passages through the connection piece 46. The connection piece 46, as shown in FIG. 2, is depicted as a one-piece element, however, the present invention is not limited in this regard as the connection piece 46 may be alternatively formed by a plurality of electrically interconnected elements without departing from the broader aspects of the present invention.

The second portion 34 further includes a scotchcast 60 through which the electrical cable 58 is fed. The scotchcast 60 is adapted to include a first mating end 62 and a second mating end 64 and provides, inter alia, a water-tight protective enclosure for the interface between the connecting tip 50 and the electrical cable 58. The first mating end 62 is configured to integrally mate with the connecting tip 50 and therefore has a series of threads inscribed about the inner circumference thereof. In addition, the first mating end 62 includes has a series of threads inscribed about the outer circumference thereof for integrally mating with a protective sheath 80, to be discussed in more detail later.

The second mating end 64 has a series of threads inscribed about the inner circumference thereof for securably seating an end plug 66 and a seal 68 so as to secure the scotchcast 60 against contamination from water or other debris. The scotchcast 60 further includes a pair of wings 70 each having an anchor hole 72 formed therein for dragging or pulling the pigtailed scotchcast assembly 30 along a cavity or piping.

While a pair of wings 70 has been described as facilitating the dragging or pulling of the scotchcast 60 along a cavity or piping, the present invention is not limited in this regard as alternative locations for the anchor holes, such as through the body of the scotchcast 60, may be utilized without departing from the broader aspects of the present invention. Moreover, other known methods for dragging the pigtailed scotchcast assembly 30 are also contemplated by the present invention.

In operation, the electrical cable 58 is chosen in dependence upon the electrical capacity desired and is threaded through the end plug 66, seal 68 and scotchcast 60, to be electrically coupled to the posts 56 through a soldering action or the like. The internal threads of the first mating end 62 are then selectively mated with the threads of the connecting tip 50 until the first mating end 62 is securely seated against a flange 54 of the connection piece 46. The end plug 66 and the seal 68 are subsequently mated with the internal threads of the second mating end 64, thereby effectively sealing the interior of the scotchcast 60 in a water-tight manner.

Figure 3:
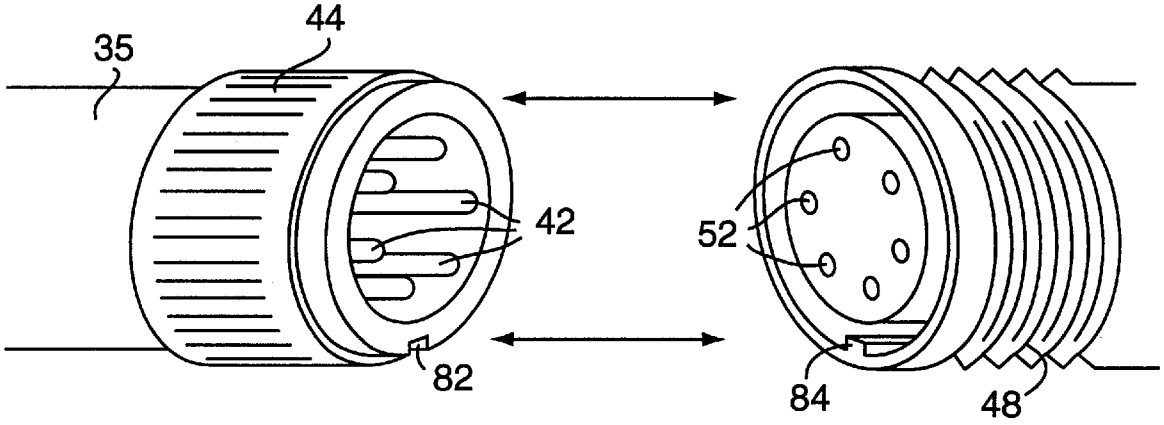
FIG. 3 illustrates a slide and keyway arrangement incorporated into the two-piece pigtailed scotchcast assembly of the present invention.

The first portion 32 and the second portion 34 are initially engaged by inserting the connection pins 42 into their respective pin receptacles 52. As depicted in FIG. 3, the proper orientation of the connecting pins 42 and the pin receptacles 52 are maintained through at least one slide 84 and keyway 82, formed in the female attachment end 48 and central housing 35, respectively. The operation ring 44 is then selectively rotated to bring the female attachment end 48 and central housing 35 into water-tight communication with one another.

Once mated in this manner, the interface between the first portion 32 and the second portion 34 is further protected against contamination and wear through the operation of the protective sheath 80, depicted in cut-away fashion in FIG. 2. The protective sheath 80 is a hollow tube, preferably formed form a highly resilient material such as a metal or the like, and is freely insertable over the pigtails 36 and the central housing 35. The protective sheath 80 has threads inscribed about the inner circumference of at least one end so as to be selectively engageable with the exterior threads of the first mating end 62. When so mated, the protective sheath 80, the first portion 32 and the second portion 34 combine to form the pigtailed scotchcast assembly 30 of the present invention.

As will also be appreciated from close inspection of FIG. 2, the protective sheath 80 has an outer diameter, which is substantially equal to an outer diameter 60*a* of the main body portion of the scotchcast 60. With this configuration, when the protective sheath 80 is fully seated about the first mating end 62, the outer surface of the protective sheath 80 and the outer surface of the scotchcast 60 will be uniformly coextensive with one another. That is, when fully seated, the transitional area between the protective sheath 80 and the scotchcast 60 will be substantially smooth and continuous.

Now that the pigtailed scotchcast assembly 30 has been described in connection with the drawing FIGS. 2–3, the benefits and advantages of such a configuration, as compared to the prior art one-piece scotchcast configuration illustrated in FIG. 1, will be readily evident.

After extended use of the two-piece pigtailed scotchcast assembly 30, the pigtails 36 and connection ends 38 may become worn and tattered to the point where replacement is necessary. Alternatively, an operator may selectively choose to exchange the pigtails 36 with another set of pigtails due to the specific equipment requirements of a particular job. In any case, when replacement or exchange is necessary, an operator need only to disengage the protective sheath 80 from the first mating end 62 of the scotchcast 60, and similarly disengage the operation ring 44 from the threads of the female attachment end 48. In this manner, the pigtails 36 may be removed from the pigtailed scotchcast assembly 30 to provide for the subsequent mating for yet another pigtailed element.

It is therefore an important aspect of the present invention that this replacement or exchange of a pigtailed element take place without the need of cutting and splicing the electrical cable 58, thereby reducing the technical knowledge necessary for such an operation.

It is another important aspect of the present invention that the existing scotchcast 60 may be reused with another pigtailed element, thereby reducing the cost and waste associated with such an operation.

It is another important aspect of the present invention that the replacement or exchange of a pigtailed element may be advantageously accomplished without the need of special equipment or training, further reducing the cost of such an operation. Moreover, the desired replacement or exchange may be accomplished in a fraction of the time previously required, allowing less down-time for both the equipment and the operator on a given job.

Furthermore, an operator need no longer wait the time period previously necessary for the resin and catalyst compound to cure before the entire pigtailed scotchcast assembly 30 may be utilized in the pre- or post-inspection of a cavity or pipe.

The inclusion of the protective sheath 80 is yet another important aspect of the present invention, as such, an element provides a level of contamination and wear protection to the critical areas of the pigtailed scotchcast assembly 30 heretofore unknown in the art. In addition, the protective sheath 80, the varying length of which is also contemplated by the present invention, provides an impediment to the flexing of the pigtailed scotchcast assembly 30 in those areas of the pigtailed scotchcast assembly 30 which are most sensitive to such flexing by providing a rigid shaft about these sensitive areas.

Moreover, by adapting the pigtailed scotchcast assembly 30 so that the transition between the protective sheath 80 and the scotchcast 60 is substantially smooth and continuous, the present invention eliminates the chance that the pigtailed scotchcast assembly 30 will become snagged upon items or protrusions within the cavity being inspected. In such a manner, the protective sheath 80 is less likely to become dislodged, thereby extending the life of the pigtailed scotchcast assembly 30.

The pigtailed scotchcast assembly 30 illustrated in FIGS. 2–3 is operational without injecting the inner housing of the scotchcast 60 with a non-conductive resin and catalyst compound and has an approximate 500 lb. pulling capacity. The present invention is not limited in this regard, however, as the inner housing of the scotchcast 60 may be injected with either a non-conductive resin and catalyst compound or a dielectric fluid, such as oil or the like, in order to ensure that the inner housing of the scotchcast 60 is maintained in a hydrophobic state. As depicted in FIG. 2, a resin or fluid substance may be injected into the inner housing of the scotchcast 60 via any number of injection apertures 63 formed in the housing of the scotchcast 60. The injection apertures 63 may be subsequently sealed in any conventional manner, such as by utilizing set screws or the like.

By filling the inner housing of the scotchcast 60 with a resin and catalyst compound, the pulling capacity of the scotchcast 60 may be increased from approximately 500 lbs. to approximately several thousands of pounds. In these cases, the pigtailed scotchcast assembly 30 would require heating of the scotchcast 60 in order to liquefy the injected resin compound prior to replacing the electrical cable 58, should replacement become necessary.

Figure 4:
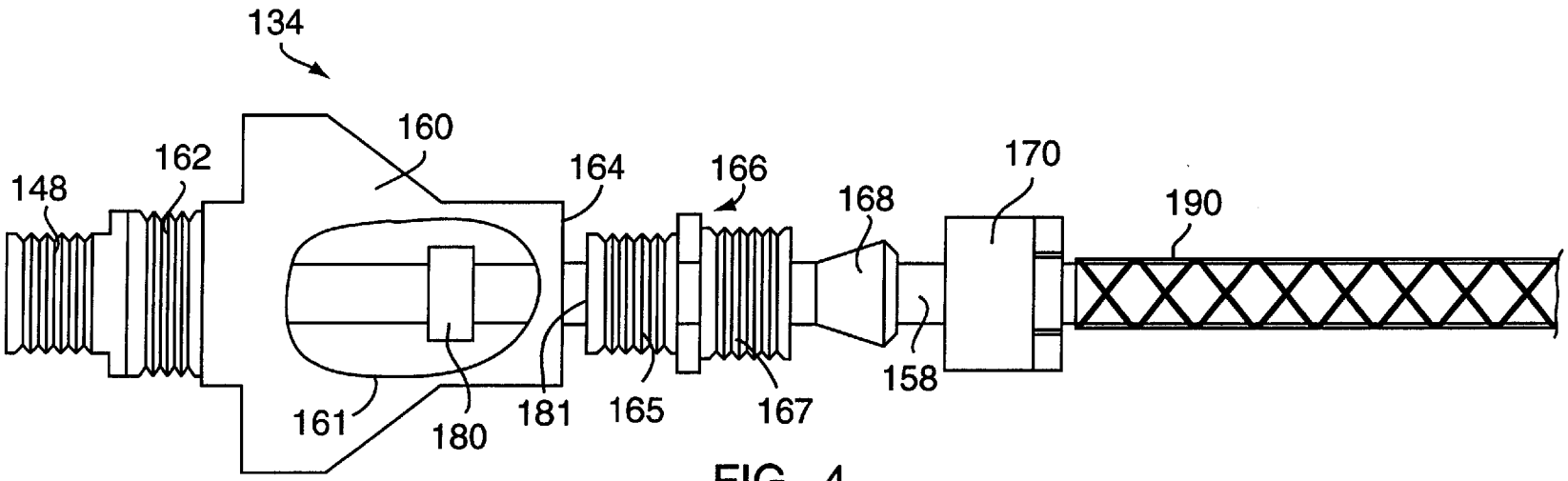
FIG. 4 is a composite view of a second portion of a two-piece scotchcast assembly, according to another embodiment of the present invention.

FIG. 4 illustrates another embodiment of a second portion 134, whereby the pulling capacity of the pigtailed scotchcast assembly 30 is substantially increased. As seen in FIG. 4, a female attachment end 148 threadedly engages a first mating end 162 of the scotchcast 160. An end plug 166 is slidable along an electrical cable 158 and includes a first plug end 165 and a second plug end 167 wherein the first plug end 165 threadedly engages a second mating end of the scotchcast 160. A seal 168 is also slidably mounted about the electrical cable 158 and provides a water-tight barrier when properly seated between the second plug end 167 and the electrical cable 158. An end cap 170 is slidably mounted about the electrical cable 158 and includes threads formed about the inner periphery thereof so as to threadedly engage with the second plug end 167.

A cut-out 161 is schematically shown in FIG. 4 to reveal a clamp 180 located within the housing of the scotchcast 160 and centered about the electrical cable 158. The clamp 180 is formed from a wear resistant material, such as metal or the like, and is held to the electrical cable 158 in a non-slidable fashion, through friction, in any of a number of conventional manners. When the end plug 166 is fully engaged with the second mating end 164, the electrical cable 158 is prohibited from being pulled free of the scotchcast 160 by the abutment between the clamp 180 and an end face 181 of the first plug end 165. The clamp 180 therefore greatly increases the pulling capacity of the scotchcast 160.

Also depicted in FIG. 4 is a tension web 190, which extends along the length of the electrical cable 158 and provides additional pulling capacity to the scotchcast 160. The tension web 190 is typically formed from a weave of metal, nylon or other resilient material and serves to tighten about the electrical cable 158 in proportion to the pull exerted upon the tension web 190. When utilized as a whole, the clamp 180 and the tension web 190 allow the scotchcast 160 to withstand stresses up to approximately 5000 lbs. of pulling capacity without endangering the integrity of the electrical cable 158.

It should be understood that a combination of the features depicted in FIGS. 2–4 may be assimilated in a pigtailed scotchcast assembly of the present invention. Moreover, the scotchcast 160 may also be injected with either a resin compound or a dielectric fluid, so as to further increase the pulling capacity of the scotchcast 160, as well as reinforcing the hydrophobic environment within the housing of the scotchcast 160. It will, however, be readily appreciated that a major aspect of the present invention resides in the ability of a pigtailed scotchcast assembly equipped with either, or both, a clamp 180 and a tension web 190, to withstand excessive pulling tensions without the need for a resin filled scotchcast 160.

While a preferred embodiment has been shown and described, various modifications and substitutions may be made without departing from the spirit and scope of the present invention. Accordingly, it is to be understood that the present invention has been described by way of example, and not by limitation.

What is claimed is:

1. An integrated inspection apparatus for selectively housing therein an electrical cable having a plurality of conductors and terminating in a pigtail, comprising:

a first portion adapted to have said pigtail extending from one end and including a male end oriented adjacent another end thereof;

a second portion including a scotchcast adapted to have said electrical cable extending from one end and including a female end oriented adjacent another end thereof, said second portion further comprising a connection piece including a plurality of posts extending from one end and adapted to be fixedly mated to said conductors, said connection piece housing said female end adjacent another end thereof, said connection piece being adapted to be releasably mated to said another end of said scotchcast;

a slide member included on one of said connection piece and said first portion;

a keyway included on the other of said connection piece and said first portion, wherein said slide and keyway are adapted to mate with one another so as to ensure proper alignment between said male end and said female end;

a plurality of pins extending from said male end;

a plurality of pin receptacles being formed in said female end, wherein said male end and said female end are selectively engageable;

an operation ring circumscribing said first portion, said operation ring being freely rotatable about said first portion and adapted to inlcude threads inscribed about an inner periphery thereof, wherein said pins are received within said pin receptacles when said threads are brought into engagement with a plurality of matching threads inscribed about an outer periphery of said female end by selective operation of said operation ring;

a seal circumscribing said electrical cable; and an end plug circumscribing said electrical cable for selectively engaging said one end and said seal, wherein said seal provides a water-tight barrier between said electrical cable and said end plug.

2. The integrated inspection apparatus for selectively housing therein an electrical cable having a plurality of conductors and terminating in a pigtail according to claim 1, wherein:

said connection piece includes an outwardly extending flange about the circumference thereof; and said flange abuts said another end of said scotchcast when said connection piece is mated to said another end of said scotchcast.

3. The integrated inspection apparatus for selectively housing therein an electrical cable having a plurality of conductors and terminating in a pigtail according to claim 1, wherein:

said integrated inspection apparatus further comprises a protective sheath adapted to surround an interface between said first portion and said second portion when said first portion and said second portion are mated to one another.

4. The integrated inspection apparatus for selectively housing therein an electrical cable having a plurality of conductors and terminating in a pigtail according to claim 3, wherein:

said protective sheath is a rigid cylinder having a uniform inner diameter along its entire length.

5. The integrated inspection apparatus for selectively housing therein an electrical cable having a plurality of conductors and terminating in a pigtail according to claim 4, wherein:

said protective sheath has a uniform outer diameter which is equal to an outer diameter of said scotchcast.

6. The integrated inspection apparatus for selectively housing therein an electrical cable having a plurality of conductors and terminating in a pigtail according to claim 3, wherein:

said protective sheath is freely slidable about said first portion and is adapted to include threads inscribed about the inner periphery thereof; and wherein said threads of said protective sheath are adapted to mate with said another end of said scotchcast when said first portion and said second portion are mated to one another.

7. The integrated inspection apparatus for selectively housing therein an electrical cable having a plurality of conductors and terminating in a pigtail according to claim 6, wherein:

an outer surface of said protective sheath is adapted to be uniformly coextensive with an outer surface of said scotchcast when said first portion and said second portion are mated to one another.

8. The integrated inspection apparatus for selectively housing therein an electrical cable having a plurality of conductors and terminating in a pigtail according to claim 7, wherein:

said scotchcast includes a wing formed on said outer surface thereof; and said wing is adapted to include an anchor hole.

9. The integrated inspection apparatus for selectively housing therein an electrical cable having a plurality of conductors and terminating in a pigtail according to claim 1, wherein:

said seal is formed of a compressible material and is oriented between said scotchcast and said end plug.

10. The integrated inspection apparatus for selectively housing therein an electrical cable having a plurality of conductors and terminating in a pigtail according to claim 1, wherein:

said seal is formed of a compressible material and is oriented between said end plug and an end cap, said end cap selectively engaging said end plug.

11. The integrated inspection apparatus for selectively housing therein an electrical cable having a plurality of conductors and terminating in a pigtail according to claim 1, wherein:

said seal is a cylinder having a first end and a second end, said first end of said seal being oriented closer to said scotchcast than said second end of said seal; and aid seal is tapered along its length so that an annulus adjacent said first end of said seal is greater in width than an annulus adjacent said second end of said seal.

12. The integrated inspection apparatus for selectively housing therein an electrical cable having a plurality of conductors and terminating in a pigtail according to claim 1, wherein:

an inner housing of said scotchcast is injected with a dielectric, thereby forming a hydrophobic environment; and said electrical cable is wrapped with a tension webbing along its length thereof.

13. The integrated inspection apparatus for selectively housing therein an electrical cable having a plurality of conductors and terminating in a pigtail according to claim 1, wherein:

said integrated inspection apparatus further comprises a clamp circumscribing said electrical cable and held in tight contact thereto, said clamp oriented within said scotchcast between said one end and said another end.

* * * * *

UNITED STATES PATENT AND TRADEMARK OFFICE

CERTIFICATE OF CORRECTION

PATENT NO. : 6,250,955 B1
DATED : June 26, 2001
INVENTOR(S) : David Archuleta

It is certified that error appears in the above-identified patent and that said Letters Patent is hereby corrected as shown below:

Title page,
Item [57], ABSTRACT,
Line 9, after "pigtails" please insert -- (36) --.

Signed and Sealed this

Third Day of December, 2002

JAMES E. ROGAN
*Director of the United States Patent and Trademark Office*